US005167135A

United States Patent [19]

Gobeski

[11] Patent Number: 5,167,135

[45] Date of Patent: Dec. 1, 1992

[54] SAFETY LOCKOUT ADAPTER AND COUPLING MEMBER USED THEREFOR

[75] Inventor: David L. Gobeski, Greenville, N.C.

[73] Assignee: East Carolina University, Greenville, N.C.

[21] Appl. No.: 758,910

[22] Filed: Sep. 13, 1991

[51] Int. Cl.[5] ..... E05B 73/00

[52] U.S. Cl. ..... 70/14; 70/19; 70/203; 70/441; 16/260; 200/43.15

[58] Field of Search ..... 70/14, 18, 19, 176–178, 70/164, 180, 203, 432, 441; 16/260, 267, 269; 251/90; 200/43.14, 43.15

[56] References Cited

U.S. PATENT DOCUMENTS

| | | | |
|---|---|---|---|
| 729,773 | 6/1903 | Katz et al. | 70/432 |
| 1,197,020 | 9/1916 | Farrar | 70/203 |
| 2,101,446 | 12/1937 | Neiman | 70/441 |
| 3,667,259 | 6/1972 | Reque et al. | 70/14 |
| 4,085,599 | 4/1978 | Fischer et al. | 70/14 |
| 4,897,515 | 1/1990 | Zubar et al. . | |

FOREIGN PATENT DOCUMENTS

| | | | |
|---|---|---|---|
| 346278 | 12/1921 | Fed. Rep. of Germany | 70/14 |
| 339604 | 12/1930 | United Kingdom | 70/203 |
| 489155 | 7/1938 | United Kingdom | 70/19 |
| 560054 | 3/1944 | United Kingdom | 70/428 |

*Primary Examiner*—Renee S. Luebke
*Assistant Examiner*—D. Boucher
*Attorney, Agent, or Firm*—Bell, Seltzer, Park & Gibson

[57] ABSTRACT

A safety lockout adapter is formed of two coupling members. Each coupling member is adapted to couple with another corresponding coupling member of substantially similar configuration for locking-out power disconnects or fluid line disconnects. When connecting the members to the power disconnect handle, a worker must use both hands. Each coupling member comprises a substantially rigid and planar member having opposing front and rear edges and opposing side edges defining front and rear portions. The front portion includes on one of the side edges an arcuate portion extending inwardly to form a substantially concave cut-out and a hook portion defined by the front edge and projecting toward the side from the front of the concave cut-out. Means positioned along the side edge opposite the arcuate cut-out holds together two coupling members when reversed and coupled in overlapping registry with each other. The rear portion of each coupling member has a plurality of holes therein which are positioned to align with the holes of the other coupling member when both members are coupled together to permit padlocks to be inserted through the aligned holes.

16 Claims, 2 Drawing Sheets

SAFETY LOCKOUT ADAPTER AND COUPLING MEMBER USED THEREFOR

FIELD OF THE INVENTION

This invention relates to a safety lockout adapter for locking-out power disconnects or fluid lines such as air lines and hydraulic lines, and more particularly to a safety lockout adapter formed from two coupling members positioned in overlying relation to each other.

BACKGROUND OF THE INVENTION

The Occupational Safety and Health Administration requires that workers lock out the power supplied to equipment while it is maintained and repaired, or in some instances, lock out fluid lines, such as air lines and hydraulic lines. For example, U.S. Pat. No. 3,667,259 proposes a safety lockout adapter that includes a pair of pivotally connected members each having a shank portion and a hook portion that flush together in overlying relation to each other. The hooks are adapted for extending through a hole of a disconnect handle of a power switch, or fluid line such as an air line or hydraulic line, for locking out the equipment in question. Each shank portion includes a plurality of holes that are aligned in registry to each other when the two shanks are flushed together. Padlocks are placed through aligned holes, allowing each worker maintaining and repairing the equipment to lock-out the equipment. Only when all workers have removed their personal pad locks, can one activate the power to the equipment.

This proposed safety lockout adapter can be manipulated in one hand and secured to a power box usually with little difficulty. However, in some instances, the proposed prior art lockout adapter may be difficult to use. For example, if a large object is positioned adjacent the power box or the fluid line, the user may have difficulty reaching around the object and connecting the proposed prior art safety lockout adapter to the disconnect handle.

A two member safety lockout adapter requiring a user to use both hands and reach around the object to couple the members together would be preferred in these circumstances. Additionally, some safety regulators have expressed a preference for a two member safety lockout adapter requiring a user to use both hands when coupling a lockout adapter to a disconnect handle of a power box, or onto a fluid line. With a two member lockout adapter requiring use of two hands, a user would not be free to use one hand for other chores or repairs while locking out.

The other prior art proposals also are limited in the number of padlocks that can be placed onto the adapter. In some jobs, many workers are repairing a large item or working in a closely confined area. In those instances, each worker must lock out on the adapter by placing a padlock through a hole. If all holes are used, some workers may not have locked out. As a result, a worker may be left working on the equipment after the last padlock has been removed from the lockout adapter. The power may be activated with a worker still maintaining or repairing the equipment, possibly resulting in injury to the worker.

Additionally, because workers who need safety lockout adapters typically travel into areas where items such as the adapters can be lost or misplaced, it is desirable to provide an inexpensive safety lockout adapter formed as two members that are readily interchangeable in case one of the members are lost and must be substituted.

SUMMARY OF THE INVENTION

It is therefor an object of the present invention to provide a coupling member adapted for coupling with another corresponding coupling member of substantially similar configuration for locking out power disconnects or fluid lines.

It is another object of the present invention to provide a safety lockout adapter in which several adapters may be coupled together to allow more padlocks to be used when one adapter is filled to capacity.

It is another object of the present invention to provide a safety lockout adapter in which a user must use both hands to place the adapter on the lockouts for fluid lines or the power disconnect handles used in locking out power to equipment.

It is another object of the present invention to provide a safety lockout adapter that is formed from two separate members, which are coupled together when locking-out.

It is another object of the present invention to provide a safety lockout adapter that is formed from two similarly configured interchangeable coupling members.

The present invention provides a safety lockout adapter formed from two similarly configured coupling members. Each coupling member is adapted for coupling with another corresponding coupling member of substantially similar configuration for locking-out power disconnects or fluid line disconnects. When connecting the members to a power disconnect handle, fluid line disconnect, a worker must use both hands.

Each coupling member comprises a substantially rigid, planar body having opposing front and rear edges and opposing side edges defining front and rear portions. The front portion includes on one of the side edges an arcuate portion extending inwardly to form a substantially concave cut-out and a hook portion defined by the front edge and projecting toward the side from the front of the concave cut-out. Means positioned along the side edge opposite the arcuate cut-out holds together two coupling members when reversed and coupled in overlapping registry with each other. The rear portion of each coupling member has a plurality of holes therein which are positioned to align with the holes of the other coupling member when both members are coupled together to permit padlocks to be inserted through the aligned holes.

In a preferred embodiment the hook portion is tapered from large to small starting at the concave cut-out to define a point at the end which is adapted to be inserted within one of the set of aligned holes when both members are coupled together. The plurality of holes are serially arranged from the rear edge upward toward the front edge. In one preferred embodiment, the hole most adjacent the rear edge is positioned so that when the two members are coupled together, the holes adjacent the rear edge are offset to each other and form an opening dimensioned to allow the hook portion of a coupling member to be inserted therethrough but prevent a padlock from being passed therethrough. In another embodiment, one of the set of holes includes identifying indicia for indicating to a worker the holes that should not be locked-out so that a second coupling member can be secured thereto.

The means positioned along the side edge for holding together two coupling members comprises a folded over edge portion forming an envelope opening dimensioned for allowing an interference fit between the folded-over edge portion and the respective side edge when two members are coupled together. The front edge also includes a folded-over portion forming an envelope dimensioned for allowing an interference fit between the folded-over edge portion and the respective hook portion when two members are coupled together. The folded over edge portion on the front edge extends substantially halfway across the front edge to a point where the hook portion begins so that side edges of the folded-over portion confront each other and allow pivoting of two members about the side edges during coupling.

BRIEF DESCRIPTION OF THE DRAWINGS

The foregoing and other objects, features and advantages of the present invention will become apparent from the following detailed description of the preferred embodiment of the invention, and from the drawings in which.

DETAILED DESCRIPTION OF THE PREFERRED EMBODIMENT

Figure 1:
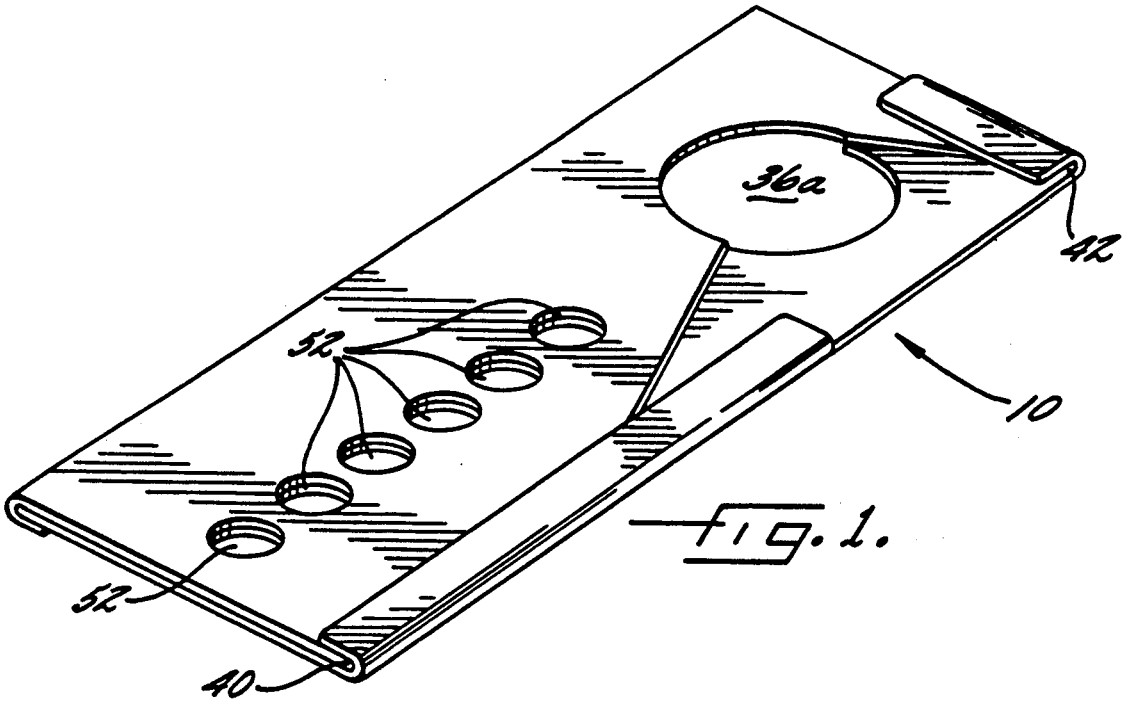
FIG. 1 is an isometric view of the safety lockout adapter in accordance with a preferred embodiment of the present invention.
Figure 2:
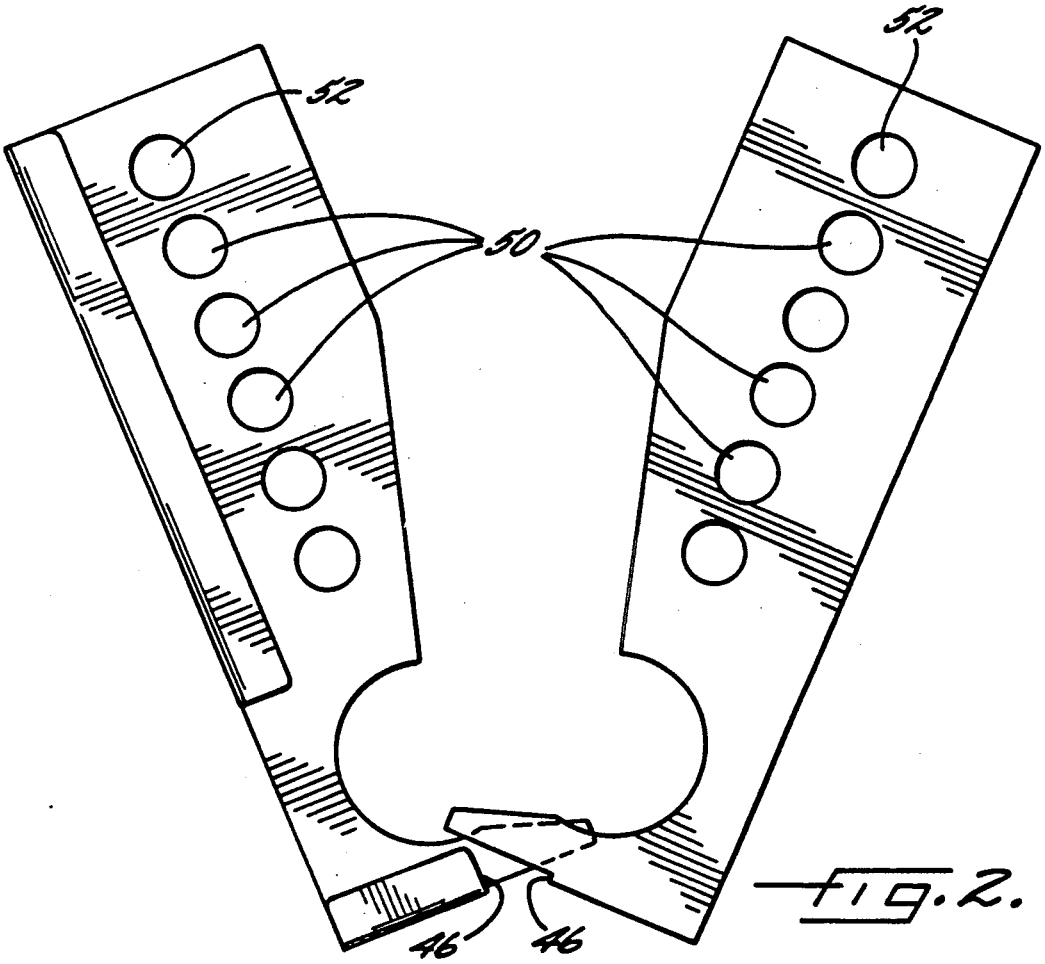
FIG. 2 is a plan view of the safety lockout adapter of FIG. 1 and showing the coupling members pivoting about the hook portions.
Figure 3A:
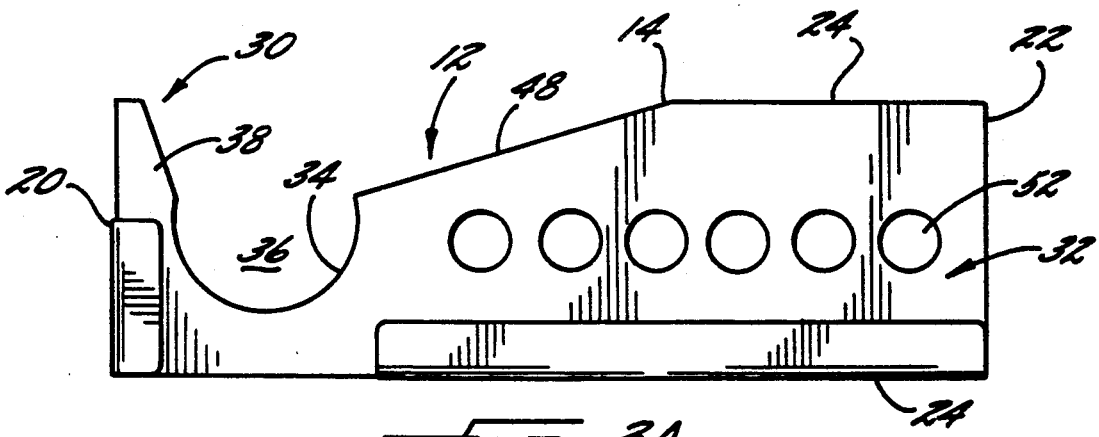
FIGS. 3A and 3B are plan views of the coupling members reversed to each other.
Figure 3B:
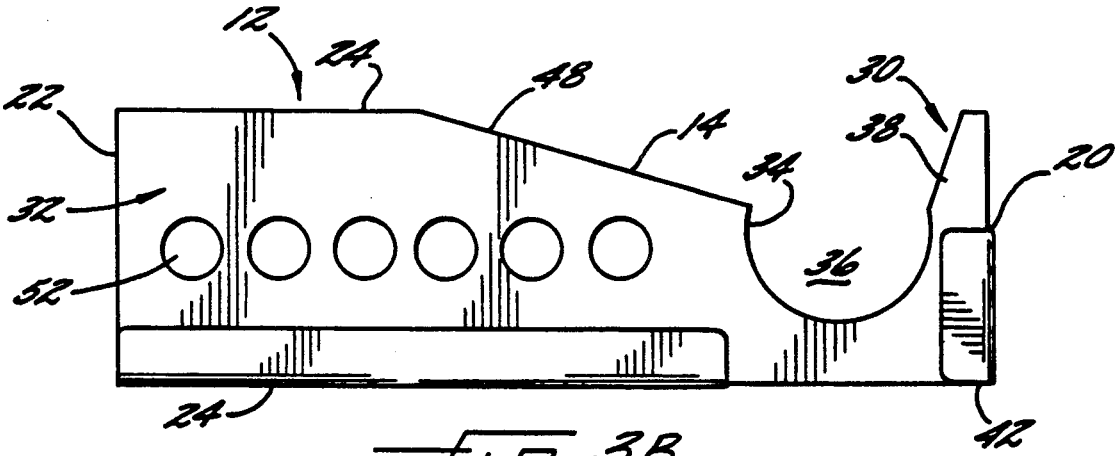

Referring now to the drawings and more particularly to FIG. 1, there is disclosed a safety lockout adapter, indicated generally at 10, that is used for locking-out power disconnects, and more particularly, used on power disconnect handles, disconnects for fluid lines, or other structures used in locking out power to equipment and other apparatus being repaired. As shown in FIGS. 3A and 3B, the safety lockout adapter is formed from two coupling members, each indicated generally at 12. In the illustrated embodiment, both coupling members 12 are substantially the same configuration and reversed to each other when coupled together.

As shown in the drawings, each coupling member is formed from a substantially rigid and planar body 14 having opposing front and rear edges 20, 22, and opposing side edges 24 defining front and rear portions, indicated respectively at 30, 32.

The front portion 30 includes on one of the side edges 24 an arcuate portion 34 extending inwardly to form a substantially concave cutout 36, and a hook portion 38 defined by the front edge 20 and projecting toward the side from the front of the concave cutout 36.

The edge 24 opposite the arcuate surface 34 is folded inwardly at the rear portion 32 to define an envelope opening 40 (FIG. 1) that is dimensioned for allowing an interference fit between the envelope opening 40 and the respective side edge 24 of another coupling member when the members are reversibly coupled together.

The front edge 20 also is folded inwardly to form a front envelope opening 42 that is dimensioned for allowing an interference fit between the front envelope opening and the respective hook portion 38 of another member when two members are coupled together in overlapping registry with each other. As best shown in FIGS. 3A and 3B, the front envelope opening extends substantially halfway across the front edge 20 to where the hook portion 38 begins so that the side edges 46 of the front envelope opening 42 confront each other when the members are joined together to permit pivoting motion of the two members during coupling. The side edge 24 on which the concave cutout 36 confronts includes an angled side edge portion 48 extending inward from the rear portion of the coupling member toward the concave cutout. The angled edge permits more efficient coupling as compared to a straighter edge because the angled edges are less likely to interfere with each other during pivoting motion.

A plurality of holes 50 are positioned in the rear portion 32 and are positioned to align with the holes of another coupling member when both coupling members are coupled together. Padlocks are inserted through the aligned holes to lock-out equipment when the adapter is connected to a power box disconnect arm. As illustrated in the drawings, the holes are serially arranged from the rear edge 22 upward toward the upper portion 30 of the coupling member. The hole 52 most adjacent the rear edge 22 on each member is positioned so that when two members are coupled together, the holes 52 adjacent the rear edge are offset to each other and form an opening dimensioned large enough to allow the hook portion of a coupling member to be inserted, but small enough to prevent a padlock from being passed therethrough.

As illustrated in the drawings, the hook portion 38 is tapered from large to small starting at the concave cutout 36 to define a narrowed end which is adapted to be inserted into the last hole when both members are coupled together and the holes 52 are misaligned, forming a smaller opening. The holes should have clearance dimensions for the two pieces that overlap at the pivot point between the two members when initially coupled together. With this dimensioning, the assembled adapter would have the folded or envelope portions abutting the adapter to which it is connected.

Figure 4:
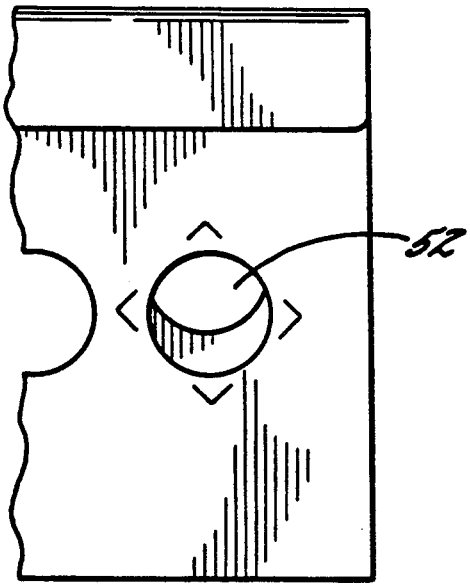
FIG. 4 is a plan view of the rear portion of the safety lockout adapter and showing the holes adjacent the rear edge offset to each other.

The rear holes 52 also could be rectangular configured and of small dimension so that when two coupling members are connected together, the rectangular holes overlap, but are dimensioned small enough to prevent a padlock from passing therethrough. In another embodiment, one of the set of aligned holes includes identifying indicia 54 (FIG. 4) to indicate to workers that a padlock or other lockout mechanism should not be placed through the hole, but instead the hole must be left open to allow another coupling member to be passed through.

The identifying indicia could be a group of marks as shown in the drawings, a color coding of the hole, punch marks, or ornamentation. Workplace safety rules may dictate that insertion of a lock into holes with identifying indicia could subject the offending party to sanctions.

The safety lockout adapter in accordance with the present invention offers several benefits over other proposed safety lockout adapters. In the present invention, a user works the safety lockout adapter with both hands by bringing separate coupling members together at their hook portion 38 and pivoting the coupling members about the envelope opening edges 46. Other coupling members having a unitary structure can be used with one hand.

Additionally, the rear misaligned holes 52 prevents insertion of a padlock when two members are coupled together. Thus, another safety lockout adapter 10 can be coupled into the rear hole and additional padlocks secured in accordance with OSHA standards. Additionally, because the safety lockout adapter is formed from two interchangeable members, manufacturing requirements and costs are reduced.

The foregoing embodiment is to be considered illustrative rather than restrictive of the invention, and those modifications which come within the meaning and range of equivalents of the claims are to be included therein.

That which is claimed is:

1. A coupling member adapted for coupling with another corresponding coupling member of substantially similar configuration for locking-out power disconnects, comprising a substantially rigid and planar body having opposing front and rear edges and opposing side edges defining front and rear portions, the front portion including on one of the side edges an arcuate portion extending inwardly to form a substantially concave cut-out and a hook portion defined by the front edge and projecting toward the side from the front of the concave cut-out, the side edge having holding means opposite the arcuate cut-out for holding together two coupling members when reversed and coupled in overlapping registry with each other, and wherein the rear portion of the coupling member has a plurality of holes therein which are positioned to align with the holes of another coupling member when both members are coupled together to permit padlocks to be inserted through the aligned holes.

2. A coupling member according to claim 1 wherein the hook portion is tapered from large to small starting at the concave cut-out to define a narrowed end that is adapted to be inserted within one of the set of aligned holes when both members are coupled together.

3. A coupling member according to claim 1 wherein the means on the side edge for holding together two coupling members comprises a dimensioned for allowing an interference fit between the envelope opening and the respective side edge of another coupling member when the members are coupled together.

4. A coupling member according to claim 1 wherein the front edge includes a folded over portion forming a front envelope opening dimensioned for allowing an interference fit between the front envelope opening and the respective hook portion of another coupling member when the members are coupled together.

5. A coupling member according to claim 4 wherein the front envelope opening extends substantially halfway across the front edge to where the hook portion begins so that side edges of the front envelope opening confront each other when members are coupled together and permit pivoting motion of two members about the side edges of the front envelope opening when members are coupled together.

6. A coupling member according to claim 1 wherein the side edge on which the concave cut-out confronts includes a tapered portion extending inward from the rear portion of the coupling member toward the concave cut-out.

7. A coupling member according to claim 1 wherein one of the plurality of holes includes identifying indicia thereon to indicate to a worker a lock should not be placed through the hole.

8. A safety lockout adapter for locking-out power disconnects comprising first and second coupling members positioned in overlying relation to each other, each coupling member comprising a substantially rigid and planar body having opposing front and rear edges and opposing side edges defining front and rear portions, the front portion of each coupling member including on one of the side edges an arcuate portion extending inwardly to form a substantially concave cut-out which is aligned with the other respective cut-out to form a circular opening, and a hook portion defined by the front edge of each coupling member and projecting toward the side from the front of the concave cut-out and, means positioned along the front edge of each coupling member for receiving the hook portion and allowing the coupling members to pivot in a plane about the hooks when the coupling members are initially brought together and coupled in overlapping registry with each other, means holding the two members together, and wherein each coupling member has a plurality of holes aligned with the holes of the other coupling member to permit padlocks to be inserted through the aligned holes.

9. A safety lockout adapter according to claim 8 wherein the hook portion is tapered from large to small starting at the concave cut-out to define a narrowed end which is adapted to be inserted within one of the set of aligned holes of another safety lockout adapter.

10. A safety lockout adapter according to claim 9 wherein the plurality of holes of each coupling member are serially arranged from the rear edge upward toward the front edge and wherein the hole adjacent the rear edge is positioned relative to the rear hole of the other coupling member to form an offset opening dimensioned large enough to allow the hook portion of a coupling member to be inserted therethrough but small enough to prevent a padlock from being passed therethrough.

11. A safety lockout adapter according to claim 8 wherein the means for holding together the coupling members comprises a folded-over edge portion positioned along the sides and forming envelope openings into which the side edge of the other respective coupling member is received.

12. A safety lockout adapter according to claim 8 wherein the front edge of each coupling member includes a folded over portion and forms an envelope opening into which the respective hook portion of the other coupling member is received.

13. A safety lockout adaptor according to claim 12 wherein the folded over edge portion on the front edge of each coupling member extends substantially halfway across the front edge to where the hook portion begins so that side edges of the front envelope openings confront each other and permit pivoting motion of two members about the side edges of the front envelope opening when the members are coupled together.

14. A safety lockout adapter according to claim 8 wherein the side edge on which the concave cutout confronts includes a tapered portion extending inward from the rear portion of each coupling member toward the concave cut-out.

15. The safety lockout adapter according to claim 8 wherein the coupling members form a substantially rectangular configuration.

16. A coupling member adapted for coupling with another corresponding coupling member of substantially similar configuration for locking-out power disconnects, comprising a substantially rigid and planar body having opposing front and rear edges and opposing side edges defining front and rear portions, the front portion including on one of the side edges an arcuate portion extending inwardly to form a substantially concave cut-out and a hook portion defined by the front edge and projecting toward the side from the front of the concave cut-out, means positioned along the side edge opposite the arcuate cut-out for holding together two coupling members when reversed and coupled in overlapping registry with each other, wherein the rear portion of the coupling member has a plurality of holes therein which are positioned to align with the holes of another coupling member when both members are coupled together to permit padlocks to be inserted through the aligned holes, wherein the hook portion is tapered from large to small starting at the concave cut-out to defined a narrowed end that is adapted to be inserted within one of the set of aligned holes when both members are coupled together, and wherein the plurality of holes are serially arranged from the rear edge upward toward the upper portion and the hole most adjacent the rear edge is positioned so that when two members are coupled together, the holes adjacent the rear edge are offset to each other and form an opening dimensioned large enough to allow the hook portion of a coupling member to be inserted therethrough but small enough to prevent a padlock from being passed therethrough.

* * * * *

UNITED STATES PATENT AND TRADEMARK OFFICE

CERTIFICATE OF CORRECTION

PATENT NO. : 5,167,135
DATED : December 1, 1992
INVENTOR(S) : David L. Gobeski

It is certified that error appears in the above-indentified patent and that said Letters Patent is hereby corrected as shown below:

Column 5, line 44, add after "comprises a" --folded over edge portion forming an envelope opening--.

Signed and Sealed this

Nineteenth Day of October, 1993

*Attest:*

*Attesting Officer*

BRUCE LEHMAN

*Commissioner of Patents and Trademarks*